United States Patent [19]

Howard

[11] 4,042,195

[45] Aug. 16, 1977

[54] MECHANISM FOR RELEASING A TOY PARACHUTE FROM A KITE STRING

[76] Inventor: Hubert M. Howard, 741 Havenhill Lane, Dallas, Tex. 75217

[21] Appl. No.: 710,589

[22] Filed: Aug. 2, 1976

[51] Int. Cl.[2] ..... A63H 27/08

[52] U.S. Cl. ..... 244/155 R

[58] Field of Search ..... 244/155 R; D34/15 AF

[56] References Cited

U.S. PATENT DOCUMENTS

| | | | |
|---|---|---|---|
| 2,680,584 | 6/1954 | Lucci et al. | 244/155 R |
| 3,961,764 | 6/1976 | Keough | 244/155 R |

FOREIGN PATENT DOCUMENTS

| | | | |
|---|---|---|---|
| 14,601 | 8/1916 | United Kingdom | 244/155 R |
| 6,493 | 4/1916 | United Kingdom | 244/155 R |

*Primary Examiner*—Trygve M. Blix
*Assistant Examiner*—Barry L. Kelmachter
*Attorney, Agent, or Firm*—Howard E. Moore; Gerald G. Crutsinger

[57] ABSTRACT

A toy release mechanism positioned on a kite string to release a toy parachute upon reaching a predetermined height along the kite string. The device comprises a body having guide loops formed on the upper end thereof which are slideably disposed on the kite string. A U-shaped bottom portion has a recess formed therein. The release arm comprises a lever arm pivotally secured to the body having a hook member secured to the lower end thereof which is slideably secured across the recess in the lower end to secure the parachute to the device. Movement of the arm toward the body releases the hook which pivots through the open recess formed in the lower portion of the body, releasing the parachute which falls to the ground. The release arm is activated by a small cork or other lightweight stop member attached to the kite string.

5 Claims, 2 Drawing Figures

MECHANISM FOR RELEASING A TOY PARACHUTE FROM A KITE STRING

BACKGROUND

Other parachute release-type toys have been devised in the past such as shown in U.S. Pat. No. 2,785,871. However, these devices have several working parts and are difficult for a small child to manipulate.

Kites are usually flown on windy days by children of all ages. Heretofore, the oldest known device to release a toy parachute from a kite string is to attach the parachute to a fish hook or hair pin and shake the string when it reaches a certain heighth to cause the parachute to fall off. However, these devices require much skill to use since the manipulation of the string may cause the kite to dive.

SUMMARY

I have devised a simple mechanism for releasing a toy parachute from a kite string. The device comprises a body having loops formed on the upper end thereof to be slideably disposed on the kite string. The body is preferably formed of lightweight Lucite material or the like and has a U-shaped lower portion. A lever arm extends outwardly above the string and is pivotally secured to the lower portion of the body and has a retaining member or hook pivotally secured to the lower end thereof. The retaining member is guided by a groove formed in one portion of the U-shaped lower end and extends across a recess formed in the U-shaped lower end.

The parachute, which comprises an umbrella shaped chute and risers, is attached to a toy such as the figure of a man and has a ring which is slideably disposed over the retaining member. The rising air currents carry the parachute up the kite string to engage a stop member attached to the kite string. The lever arm engages the stop member, pivoting same about the pivot pin to move the retaining member from the guiding groove such that the retaining member pivots on the lower end and the ring of the parachute is released to allow the parachute to fall. The parachute falls to the ground whereupon the user may retain and place the parachute back on the kite string.

Without the parachute to hold the body up, the parachute suspending body will move back toward the ground on the kite string.

The primary object of the invention is to provide a toy parachute release device which is made from relatively inexpensive raw material, such as lightweight plastic, to provide an economical structure, yet is simple to operate.

A further object of the invention is to produce a simple toy parachute device which can be operated by small children for their enjoyment when flying a kite.

It is still another object of the invention to provide a toy parachute device which is so arranged and distributed in weight characteristics that the device will return to the ground along the kite string after the parachute is released.

Other and further objects of the invention will become apparent upon detailed study of the description hereinafter following and the drawings annexed hereto.

DESCRIPTION OF THE DRAWINGS

Drawings of a preferred embodiment of the invention are annexed hereto so that the invention may be more fully understood, in which.

Numeral references are used to designate parts and like numerals are used to designate like parts throughout the various figures of the drawings.

DESCRIPTION OF A PREFERRED EMBODIMENT

Numeral 1 generally designates the body of the release mechanism slideably disposed on the kite string 2 to engage a stop member 4 to release the toy parachute 6.

Figure 1:
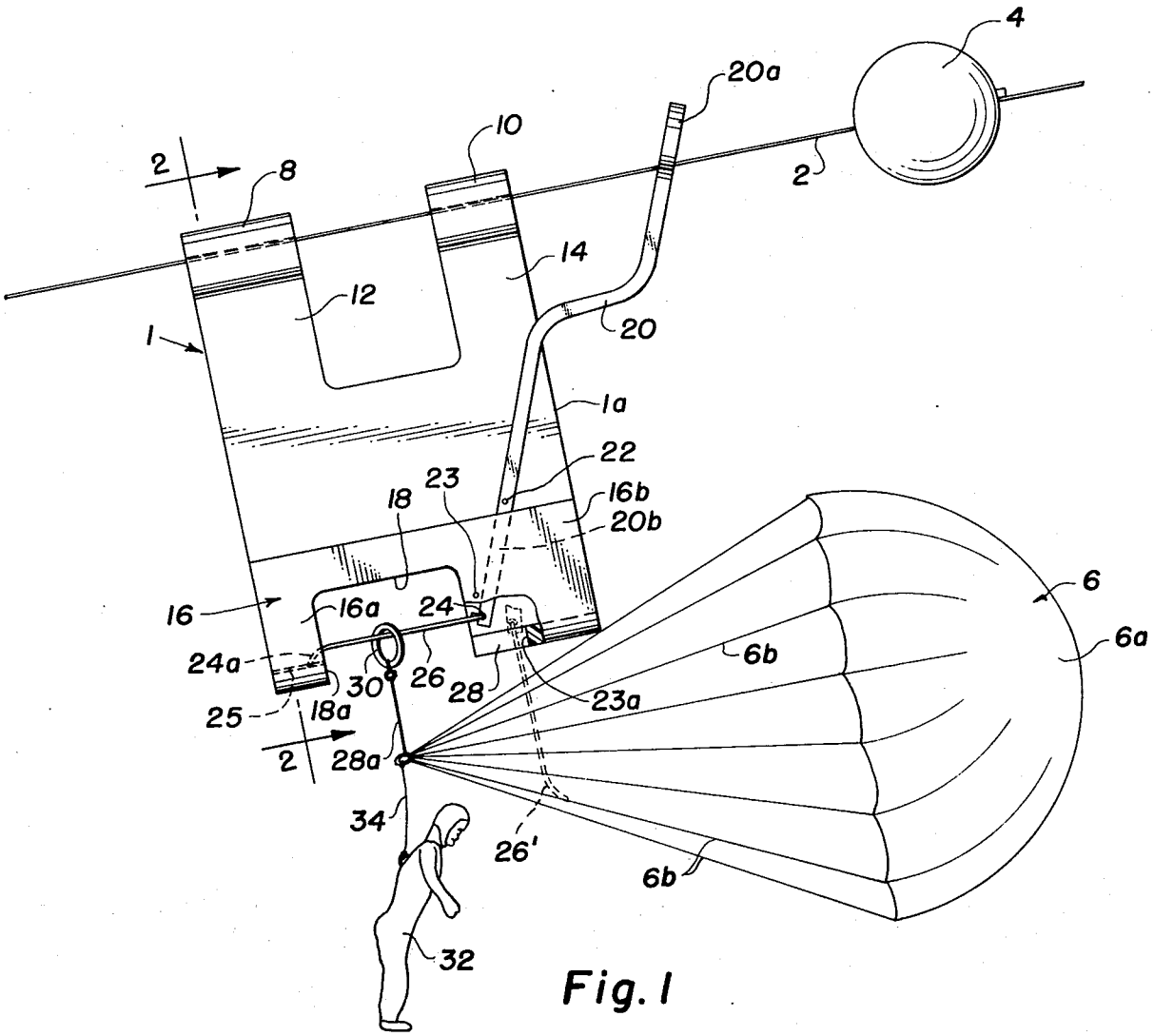
FIG. 1 is a side elevational view of the release mechanism attached to a kite string.
Figure 2:
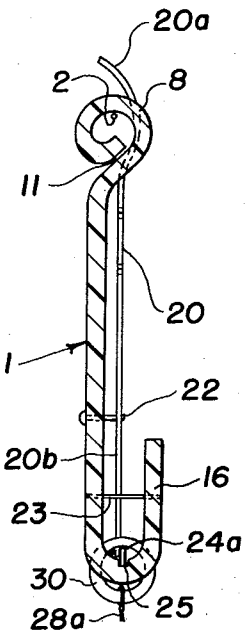
FIG. 2 is a cross-sectional view taken along line 2—2 of FIG. 1.

As best illustrated in FIGS. 1 and 2, body 1 comprises a lightweight rectangular shaped body preferably composed of a lightweight plastic material such as Lucite made by Dupont having a low coefficient of friction. The upper end of the body 1 has loops 8 and 10 formed on ears 12 and 14 which causes the upper end of the body 1 to be lighter. Loops 8 and 10 are preferably formed by turning the material in a circular loop such that a gap or slot 11 is formed to allow hooking of the loops over string 2. It should be appreciated that a single loop may be formed to hook over the string.

The lower end of body 1 has a U-shaped portion 16 formed thereon having a notch or recess 18 formed therein which forms bifurcated portions **16*a* and 16*b* in the lower end of body 1.**

Actuated means comprises a generally Z-shaped lever arm 20 pivotally secured between opposite ends thereof by a pin 22 to body 1 along the lower third portion thereof and leading edge **1*a* of body 1. Lever arm 20 has an upper portion 20*a* extending above string 2 and arranged to engage a stop member 4 on kite string 2 and a lower portion 20*b* having an aperture 24** formed in the lower end thereof.

Retaining member 26 comprises a small rigid wire member having one end secured to aperture 24 in lever arm 20 and a second deflected end **24*a* slideably disposed in groove 25 formed in the U-shaped channel 16 of body 1. The retaining member is positioned between portions 16*a* and 16*b* across recess 18 and is slideably disposed in groove 25. A notch 28 is formed in portion 16*b* of end 16 just below end 20*b* of lever arm 20 to allow pivotal movement of retaining member 26** to a position shown in dashed outline.

Parachute 6 comprises a canopy portion **6*a* constructed of cloth or plastic material and risers 6*b* attached to chute 6*a* and secured together to form a cone and attached to a string 28*a* which is secured to ring 30 slideably disposed on retaining member 26. A weighted body figure simulated of a parachute jumper 32 is suspended by string 34 to the point of the cone formed by lines 6*b*.**

It should be readily apparent from the foregoing that the rising air currents supporting the kite will carry parachute 6 upwardly along kite string 2 toward the kite. End **20*a* will engage the stop member 4 which is secured at a predetermined heighth along the kite string near the kite. Stop member 4 may be comprised of a cork or lightweight plastic ball member appropriately secured to the kite string. When end 20*a* of lever arm 20** engages stop member 4, end 20*b* pivots counterclockwise about pin 22. This pulls end 24*a* of retaining member 26 along groove 25 until end 24*a* is released from edge 18*a* of recess 18, allowing retaining member 26 to pivot to a position shown in dashed outline 26'. Ring 30 slides off of retaining member 26, allowing the simulated parachute jumper 32 and parachute 6 to float to the ground.

Upon release of the parachute the wind no longer holds the body 1 in an upward position on the kite string allowing the device to move by gravity along the string back toward the ground.

It should further be appreciated that rotation of lever 20 on pin 22 is limited by stop 23 journalled through lower end 16*b* and the abutment 23*a* formed by notch 28. This prevents jamming of the lever and maintains the device in a balanced position.

In addition end 20*a* of lever 20 may be deflected toward the string 2 as illustrated in the preferred embodiment or a loop could be formed on the end of lever 20 to pass about string 2.

It should be readily apparent from the foregoing that the objects of the invention hereinbefore discussed have been accomplished.

It should be appreciated that other and further embodiments of the invention may be devised without departing from the basic concept thereof.

Having described my invention, I claim:

1. A toy parachute release device attachable to a kite string comprising: a body having at least one loop formed on the upper end, the end of said loop being spaced from the body to allow passage of the kite string into the loop, said body further having a recess formed in the lower end thereof; a lever arm; means pivotally securing said lever arm to said body; a retaining member having one end pivotally secured to the lever arm; a U-shaped channel formed on the lower end of said body; said channel having a groove formed in the lower portion thereof to receive and guide the free end of the retaining member whereby it can slide free of the body; a parachute; means to slideably secure said parachute to the retaining member; actuating means secured to the kite string such that as the air currents carry the parachute and body upwardly along the kite string to a predetermined height the lever arm engages the actuating means to pivot the lever arm, causing the end of the lever arm attached to the retaining member to move the retaining member from engagement with the body such that the free end of the retaining member pivots downwardly to release the parachute therefrom.

2. The combination called for in claim 1 wherein the parachute comprises: a small umbrella shaped canopy; riser lines connected to the edge of the canopy at one end, said lines being gathered together at the opposite end; and means suspended to the gathered ends of the lines to weight the parachute.

3. The combination called for in claim 2 wherein the means to weight the parachute comprises a simulated parachutist.

4. The combination called for in claim 1 wherein the means to secure the parachute to the retaining member comprises: a ring; and means to secure the ring to the bottom of the parachute.

5. A toy parachute release device attachable to a kite string comprising: a body; at least one loop formed on said body, said loop being spaced from the body to allow passage of the kite string into the loop; a U-shaped channel formed on said body, said channel having a recess formed therein and said channel having a groove formed therein; actuating means secured to the kite string; an actuator arm pivotally secured immediate opposite ends thereof to the body, said arm having an upper and extending above said kite string and arranged to engage the actuating means on said kite string, said arm further having a lower end thereof extending below the pivot point into the U-shaped channel on said body; a pin to pivotally secure the arm to the body; a retaining member disposed across the recess in said channel having a first end pivotally secured to the lower end of said arm, and further having a second deflected end slideably disposed in said groove of said channel such that as the actuator arm engages the actuating means, the arm pivots, moving the lower end of the actuator arm to pull the retaining member from the groove allowing the retaining member to pivot downwardly; a ring slideably disposed on said retaining member; a parachute having risers; a simulated parachutist secured to the bottom of the risers of said parachute; and an attachment means securing the parachute to the ring such that when the retaining member pivots downwardly the ring slides off releasing the parachute and the body slides down the string by gravity.

* * * * *